US010258217B2

(12) United States Patent
Dries

(10) Patent No.: US 10,258,217 B2
(45) Date of Patent: Apr. 16, 2019

(54) DRAIN PUMP ASSEMBLY FOR A DISHWASHER APPLIANCE

(71) Applicant: Haier US Appliance Solutions, Inc., Wilmington, DE (US)

(72) Inventor: John Edward Dries, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 102 days.

(21) Appl. No.: 15/352,660

(22) Filed: Nov. 16, 2016

(65) Prior Publication Data

US 2018/0132692 A1 May 17, 2018

(51) Int. Cl.
*A47L 15/42* (2006.01)
*F04D 29/24* (2006.01)

(52) U.S. Cl.
CPC ..... *A47L 15/4225* (2013.01); *F04D 29/24* (2013.01); *F04D 29/247* (2013.01); *A47L 2501/30* (2013.01)

(58) Field of Classification Search
CPC ... A47L 15/4225; F04D 29/24; F04D 29/245; F04D 29/247; C02F 1/42; C02F 2001/422; C02F 2001/425
See application file for complete search history.

(56) References Cited

U.S. PATENT DOCUMENTS 3,033,015 A * 5/1962 Stutrud ..... D06F 39/085 134/186
3,099,992 A * 8/1963 La Flame ..... A47L 15/4225 134/182
3,510,229 A * 5/1970 Smith ..... A47L 15/4225 415/132
8,641,378 B2 2/2014 Fei et al.
2002/0122731 A1* 9/2002 Marioni ..... F04D 13/021 417/352
2003/0099539 A1* 5/2003 Preinfalk ..... F04D 15/0027 415/12
2015/0136188 A1 5/2015 Xu

FOREIGN PATENT DOCUMENTS

JP 56141095 A 11/1981
JP 2005146959 A 6/2005
WO WO-2007131658 A1 * 11/2007 ..... F04D 29/2283

OTHER PUBLICATIONS

Machine translation of JP-2005146959-A, dated Jun. 2005. (Year: 2005).*
Machine translation of WO-2007131658-A1, dated Nov. 2007. (Year: 2007).*

* cited by examiner

*Primary Examiner* — Joseph L. Perrin
*Assistant Examiner* — Kevin G Lee
(74) *Attorney, Agent, or Firm* — Dority & Manning, P.A.

(57) ABSTRACT

A dishwasher appliance is provided having a drain pump assembly including a hub mounted to a drive shaft that is driven in a first direction during a drain cycle and in a second direction during a wash/rinse cycle. One or more vanes are mounted to the hub and are rotatable between a retracted position during the drain cycle and an extended position during the wash/rinse cycle. A biasing member is mounted to each vane for urging the vanes to the retracted position to counteract the centrifugal force exerted on the vanes during operation. In this manner, the drain pump assembly pumps wash fluid during a drain cycle but does not pump wash fluid during a wash cycle.

17 Claims, 8 Drawing Sheets

DRAIN PUMP ASSEMBLY FOR A DISHWASHER APPLIANCE

FIELD OF THE INVENTION

The present disclosure relates generally to dishwasher appliances, and more particularly to an improved drain pump assembly for dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Conventional dishwasher appliances use two separate motors to operate a wash pump and a drain pump. However, additional motors take up more space, add cost, and require additional seals, thus increasing the likelihood of leaks and decreasing appliance reliability. Certain dishwasher appliances have eliminated the need for a second motor by using a single motor and a common drive shaft to rotate a wash pump impeller and a drain pump impeller. In this regard, the wash pump impeller and the drain pump impeller may be separated by a filter, and the motor may rotate in one direction to circulate wash fluid (i.e., the "wash direction") and the other to drain wash fluid (i.e., the "drain direction").

However, because impellers have the tendency to pump fluid even when rotated in the reverse direction (albeit less efficiently), the drain pump impeller may discharge water from the sump even when the motor is rotating in the wash direction. Certain dishwasher appliances have attempted to prevent this issue using complicated valve systems or one-way clutches, but these solutions may be expensive and/or increase the load on the motor.

Accordingly, a dishwasher appliance that utilizes a single motor and common drive shaft to rotate a wash pump and a drain pump would be useful. More specifically, a drain pump assembly that does not pump fluid when the common drive shaft is rotated in the wash direction would be particularly beneficial.

BRIEF DESCRIPTION OF THE INVENTION

The present subject matter provides a dishwasher appliance having a drain pump assembly including a hub mounted to a drive shaft that is driven in a first direction during a drain cycle and in a second direction during a wash/rinse cycle. One or more vanes are mounted to the hub and are rotatable between an extended position during the drain cycle and a retracted position during the wash/rinse cycle. A biasing member is mounted to each vane for urging the vanes to the retracted position to counteract the centrifugal force exerted on the vanes during operation. In this manner, the drain pump assembly pumps wash fluid during a drain cycle but does not pump wash fluid during a wash cycle. Additional aspects and advantages of the invention will be set forth in part in the following description, may be apparent from the description, or may be learned through practice of the invention.

In accordance with one exemplary embodiment of the present disclosure, a fluid circulation assembly defining a vertical direction is provided. The fluid circulation assembly includes a drive shaft defining an axial direction, a radial direction, and a circumferential direction and a motor operable to rotate the drive shaft in a first direction and in a second direction opposite the first direction. An drain pump assembly includes a hub mounted to the drive shaft and a vane coupled to the hub and being movable between an extended position when the motor is rotating in the first direction and a retracted position when the motor is rotating in the second direction. A biasing member is configured for urging the vane to the retracted position.

In accordance with another exemplary embodiment of the present disclosure, a dishwasher appliance defining a vertical, a lateral, and a transverse direction is provided. The dishwasher appliance includes a wash tub that defines a wash chamber and a wash rack mounted within the wash chamber, the wash rack being configured for receiving articles for washing. A fluid circulation assembly for providing a flow of wash fluid for cleaning articles is placed within the wash chamber. The fluid circulation assembly includes a drive shaft defining an axial direction, a radial direction, and a circumferential direction and a motor operable to rotate the drive shaft in a first direction and in a second direction opposite the first direction. A hub is mounted to the drive shaft and a vane is coupled to the hub. The vane is rotatable between an extended position when the motor is rotating in the first direction and a retracted position when the motor is rotating in the second direction. A biasing member is configured for urging the vane to the retracted position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
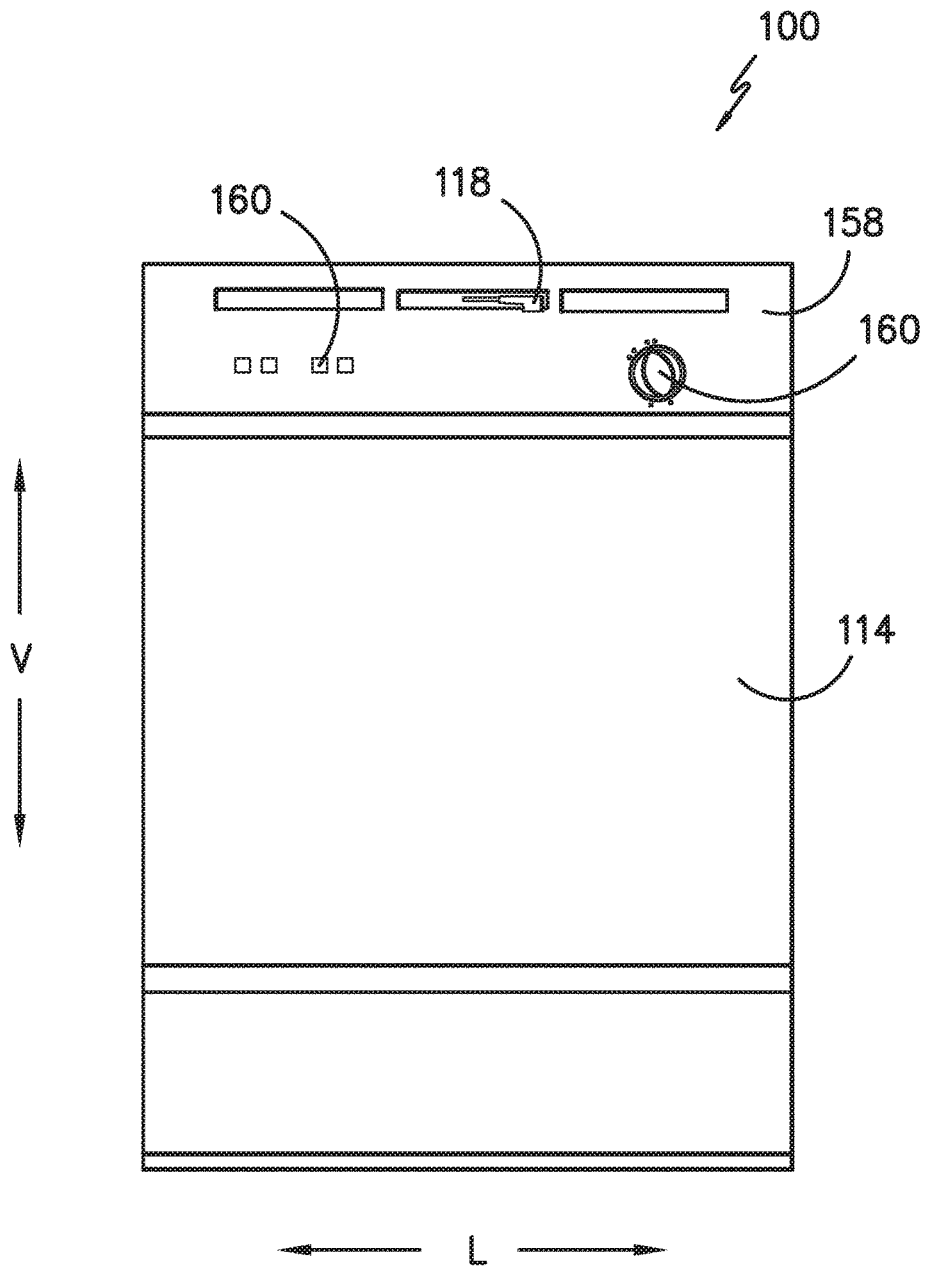
FIG. 1 provides a front view of an exemplary embodiment of a dishwashing appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments.

Figure 2:
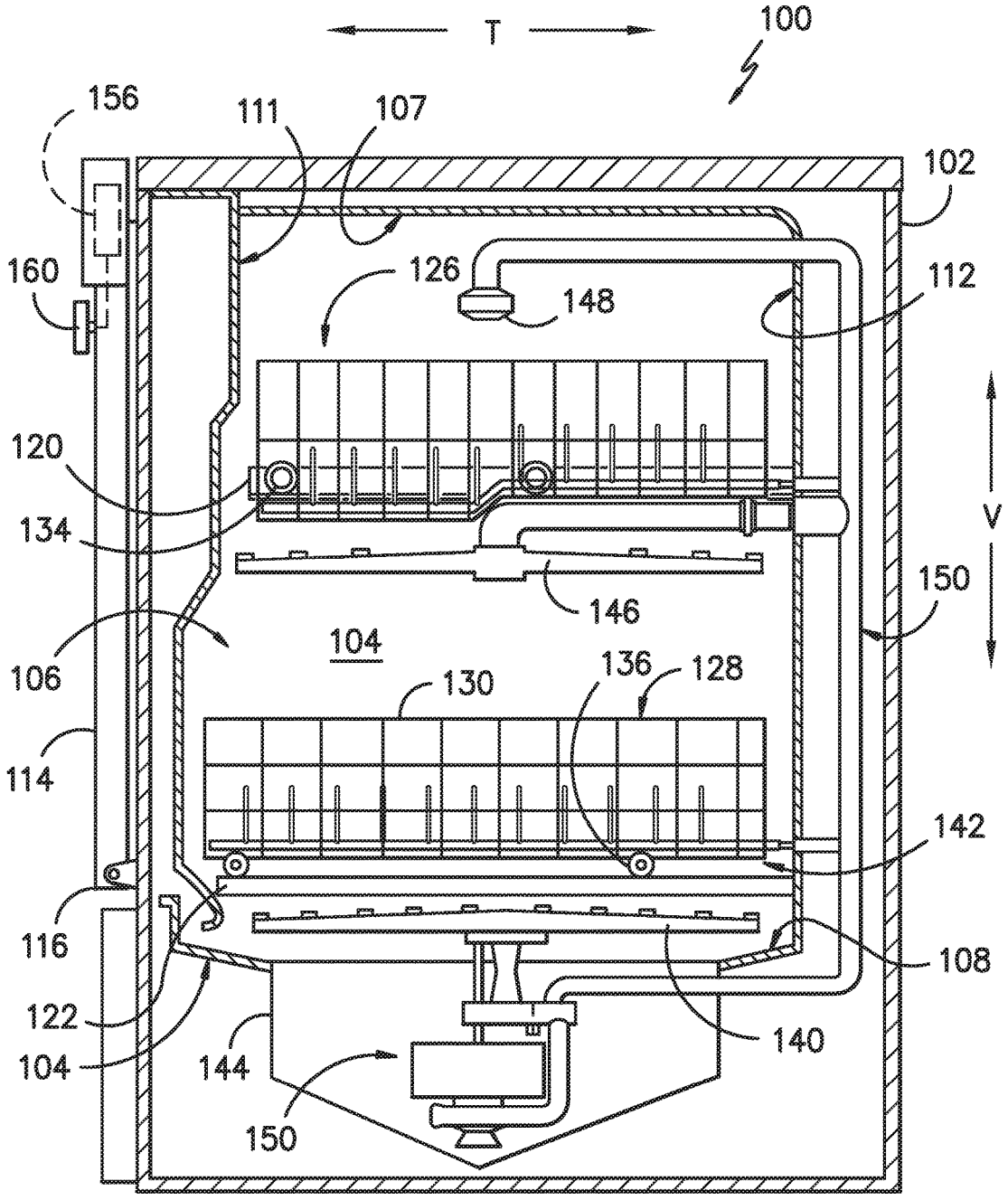
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown in FIG. 2, the tub extends between a top 107 and a bottom 108 along a vertical direction V, between a first side and a second side along a lateral direction L, and between a front side 111 and a rear side 112 along a transverse direction T. Each of the vertical direction V, lateral direction L, and transverse direction T are mutually perpendicular to one another. The tub 104 includes a front opening (not shown) and a door 114 hinged at its bottom 116 for movement between a normally closed vertical position (shown in FIGS. 1 and 2), wherein the wash chamber 106 is sealed shut for washing operation, and a horizontal open position for loading and unloading of articles from the dishwasher 100. Latch 118 is used to lock and unlock door 114 for access to wash chamber 106.

Upper and lower guide rails 120, 122 are mounted on the first and second sides of tub 104 and accommodate roller-equipped rack assemblies 126 and 128. Each of the rack assemblies 126, 128 is fabricated into lattice structures including a plurality of elongated members 130 (for clarity of illustration, not all elongated members making up assemblies 126 and 128 are shown in FIG. 2). Each rack 126, 128 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 134 and 136, for example, mounted onto racks 126 and 128, respectively. A silverware basket (not shown) may be removably attached to rack assembly 128 for placement of silverware, utensils, and the like, that are otherwise too small to be accommodated by racks 126, 128.

The dishwasher 100 further includes a lower spray arm assembly 140 that will be described in more detail below. Lower spray arm assembly 140 may be disposed in a lower region 142 of the wash chamber 106 and above a tub sump portion 144 so as to rotate in relatively close proximity to rack assembly 128. A mid-level spray arm assembly 146 is located in an upper region of the wash chamber 106 and may be located in close proximity to upper rack 126. Additionally, an upper spray assembly 148 may be located above the upper rack 126. As will be described in detail below, spray arm assemblies 140, 146, 148 may be part of a fluid circulation assembly 150 for circulating water and dishwasher fluid in the tub 104.

Each spray arm assembly 140, 146, 148 includes an arrangement of discharge ports or orifices for directing washing liquid received from fluid circulation assembly 150 onto dishes or other articles located in rack assemblies 126 and 128. The arrangement of the discharge ports, also referred to as jets, apertures, or orifices, may provide a rotational force by virtue of washing fluid flowing through the discharge ports. Alternatively, spray arm assemblies 140, 146, 148 may be motor-driven, or may operate using any other suitable drive mechanism. The resultant movement of the spray arm assemblies 140, 146, 148 provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

The dishwasher 100 is further equipped with a controller 156 to regulate operation of the dishwasher 100. The controller 156 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 156 may be positioned in a variety of locations throughout dishwasher 100. In the illustrated embodiment, the controller 156 may be located within a control panel area 158 of door 114 as shown in FIGS. 1 and 2. In such an embodiment, input/output ("I/O") signals may be routed between the control system and various operational components of dishwasher 100 along wiring harnesses that may be routed through the bottom 116 of door 114. Typically, the controller 156 includes a user interface panel/controls 160 through which a user may select various operational features and modes and monitor progress of the dishwasher 100. In one embodiment, the user interface 160 may represent a general purpose I/O ("GPIO") device or functional block. In one embodiment, the user interface 160 may include input components, such as one or more of a variety of electrical, mechanical or electro-mechanical input devices including rotary dials, push buttons, and touch pads. The user interface 160 may include a display component, such as a digital or analog display device designed to provide operational feedback to a user. The user interface 160 may be in communication with the controller 156 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 160, different configurations may be provided for racks 126, 128, different spray arm assemblies 140, 146, 148 may be used, and other differences may be applied as well.

Figure 3:
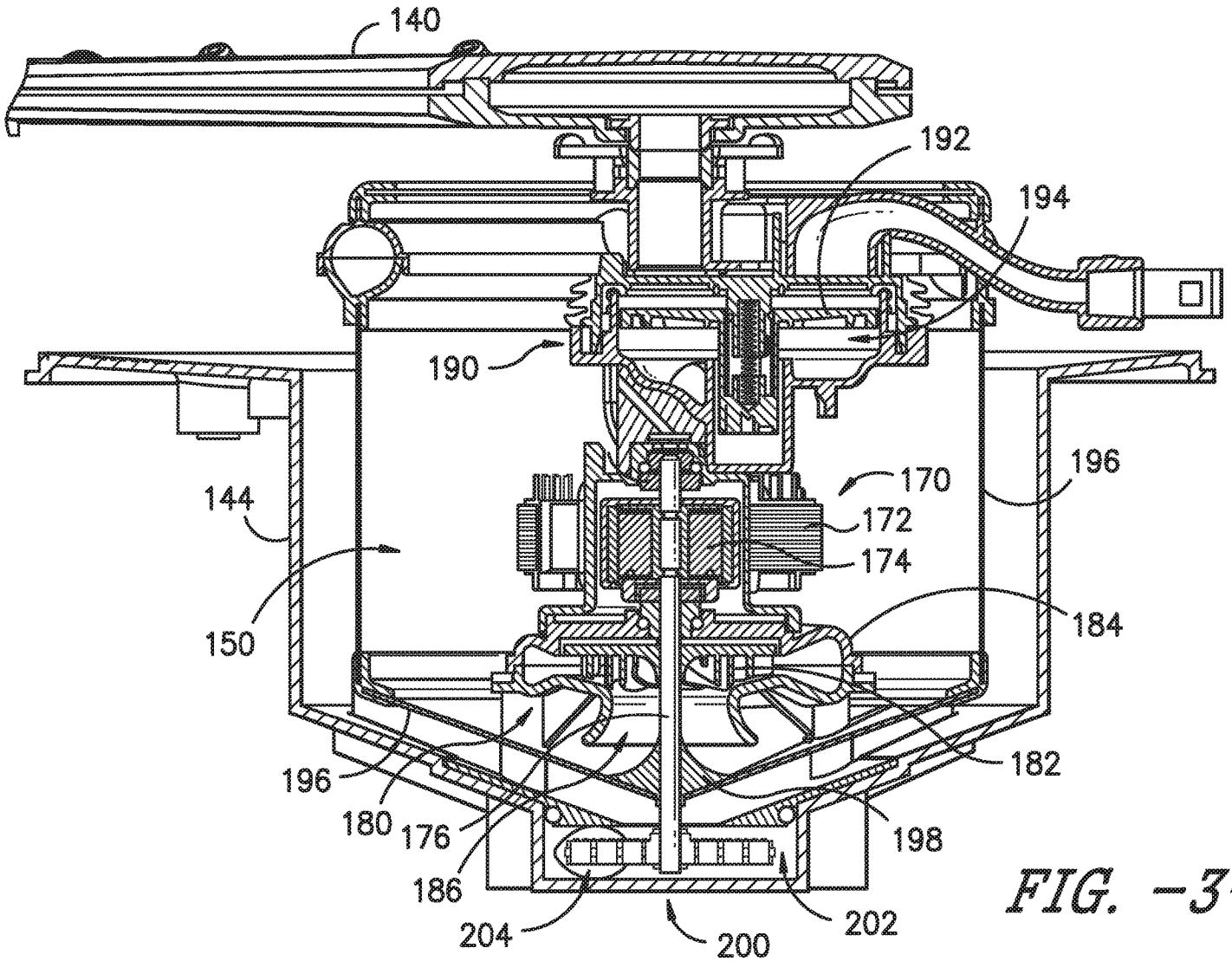
FIG. 3 provides a side, cross sectional view of a fluid circulation assembly according to an example embodiment of the present subject matter.

Referring now generally to FIG. 3, a fluid circulation assembly 150 according to an example embodiment of the present subject matter will be described. Fluid circulation assembly 150 may include a drive motor 170 that may be disposed within sump portion 144 of tub 104 and may be configured to rotate multiple components of dishwasher 100. As best shown in FIG. 3, drive motor 170 may be, for example, a brushless DC motor having a stator 172, a rotor 174, and a drive shaft 176 attached to rotor 174. A controller or control board (not shown) may control the speed of motor 170 and rotation of drive shaft 176 by selectively applying electric current to stator 172 to cause rotor 174 and drive shaft 176 to rotate. Although drive motor 170 is illustrated herein as a brushless DC motor, it should be appreciated that any suitable motor may be used while remaining within the scope of the present subject matter. For example, according to alternative embodiments, drive motor 170 may instead be a synchronous permanent magnet motor.

According to an exemplary embodiment, drive motor 170 and all its components may be potted. In this manner, drive motor 170 may be shock-resistant, submersible, and generally more reliable. Notably, because drive motor 170 is mounted inside wash chamber 106 and is completely submersible, no seals are required and the likelihood of leaks is reduced. In addition, because drive motor 170 is mounted in the normally unused space between lower spray arm 140 and a bottom wall of sump portion 144, instead of beneath the sump portion 144, this design is inherently more compact than conventional designs.

According to an exemplary embodiment, fluid circulation assembly 150 may be vertically mounted within sump portion 144 of wash chamber 106. More particularly, drive motor 170 of fluid circulation assembly 150 may be mounted such that drive shaft 176 is oriented along vertical direction V (FIG. 2) of dishwasher 100. More particularly, drive shaft 176 may define an axial direction A, a radial direction R, and a circumferential direction C (FIG. 4), with the axial direction A being parallel to the vertical direction V of the dishwasher 100. As illustrated in FIG. 3, drive shaft 176 is rotatably supported by upper and lower bearings and extends out of a bottom of drive motor 170 toward a bottom of sump portion 144.

Figure 4:
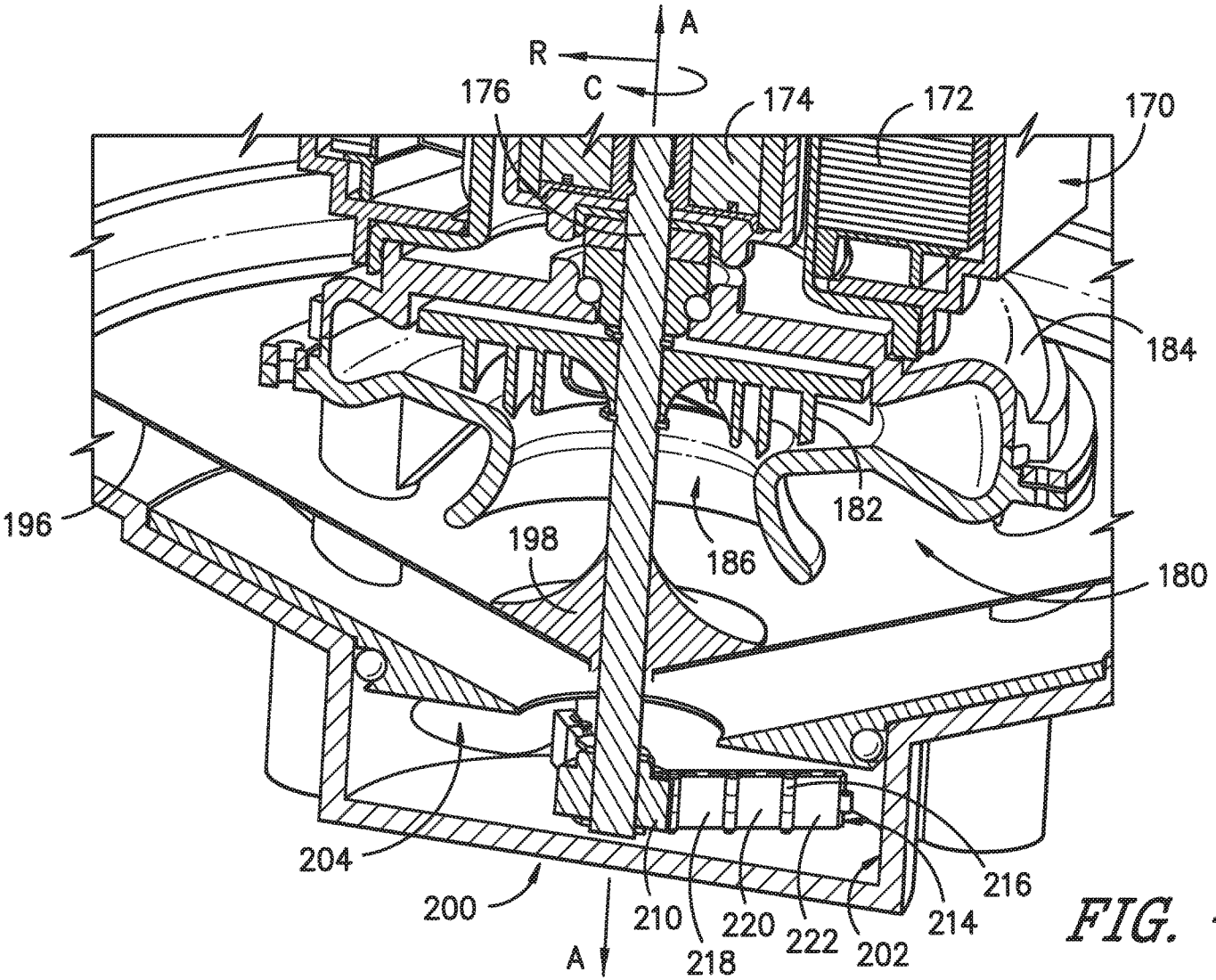
FIG. 4 provides a cross sectional view of a drain pump assembly of the exemplary fluid circulation assembly of FIG. 3 according to an exemplary embodiment of the present subject matter.

Referring now to FIGS. 3 and 4, drive shaft 176 is configured for driving a circulation or wash pump assembly 180. Wash pump assembly 180 may generally be configured for circulating wash fluid within wash chamber 106 during wash and/or rinse cycles. More specifically, wash pump assembly 180 may include a wash pump impeller 182 disposed on drive shaft 176 within a pump housing 184. Pump housing 184 defines a pump intake 186 for drawing wash fluid into wash pump impeller 182. According to the illustrated embodiment, pump intake 186 is facing downward along the vertical direction V and is located very near the bottom of sump portion 144. In this manner, the amount of water required to prime and operate wash pump assembly 180 is minimized. This is particularly advantageous when running low water cycles for the purpose of water and energy savings.

In operation, wash pump impeller 182 draws wash fluid in from sump portion 144 and pumps it to a diverter assembly 190. Diverter assembly 190 may include a diverter disc 192 disposed within a diverter chamber 194 for selectively distributing the wash fluid to the spray arm assemblies 140, 146, 148. More particularly, diverter disc 192 may be rotatably mounted about the vertical direction V. Diverter disc 192 may have a plurality of apertures that are configured to align with a one or more outlet ports at the top of diverter chamber 194. In this manner, diverter disc 192 may be selectively rotated to provide wash fluid to spray arm assemblies 140, 146, 148.

As illustrated in FIG. 3, fluid circulation assembly 150 further includes a filter 196. In general, filter 196 may define an unfiltered region and a filtered region within sump portion 144. During a wash or rinse cycle, wash fluid sprayed on dishes or other articles within wash chamber 106 falls into the unfiltered region. Wash fluid passes through filter 196 which removes food particles, resulting in relatively clean wash fluid within the filtered region. As used herein, "food particles" refers to food soil, particles, sediment, or other contaminants in the wash fluid which are not intended to travel through filter 196. Thus, a food particle seal may allow water or other wash fluids to pass from the unfiltered region to the filtered region while preventing food particles entrained within that wash fluid from passing along with the wash fluid.

As illustrated, filter 196 is a cylindrical and conical fine mesh filter constructed from a perforated stainless steel plate. Filter 196 may include a plurality of perforated holes, e.g., approximately $^{15}/_{1000}$ of an inch in diameter, such that wash fluid may pass through filter 196, but food particles entrained in the wash fluid do not pass through filter 196. However, according to alternative embodiments, filter 196 may be any structure suitable for filtering food particles from wash fluid passing through filter 196. For example, filter 196 may be constructed from any suitably rigid material, may be formed into any suitable shape, and may include apertures of any suitable size for capturing particulates.

According to the illustrated exemplary embodiment, filter 196 defines an aperture through which drive shaft 176 extends. Wash pump impeller 182 is coupled to drive shaft 176 above filter 196 and a drain pump assembly (e.g., as described below) is coupled to drive shaft 176 below filter 196 along the vertical direction V. Fluid circulation assembly 150 may further include an inlet guide assembly 198 which is configured for accurately locating and securing filter 196 while allowing drive shaft 176 to pass through aperture and minimizing leaks between the filtered and unfiltered regions of sump portion 144.

Referring now generally to FIGS. 3 through 8, a drain pump assembly 200 according to an exemplary embodiment of the present subject matter will be described. Drain pump assembly 200 may generally be configured for periodically discharging soiled wash fluid from dishwasher 100. Although illustrated and described as part of fluid circulation assembly 150, it should be appreciated that aspects of drain pump assembly 200 may be used in any impeller assembly in any application where it is desirable to selectively pump a fluid. In this regard, drain pump assembly 200 is only one exemplary configuration used for the purpose of explaining aspects of the present subject matter and is not intended to limit the scope of the invention in any manner.

Referring to FIG. 4, drain pump assembly 200 is coupled to drive shaft 176 and is positioned within a drain pump volute 202 below filter 196. Drain pump volute 202 is positioned at the very bottom of sump portion 144, such that wash fluid collects within drain pump volute 202. During a drain cycle, drain pump assembly 200 is rotated and soiled wash fluid is discharged from dishwasher 100 through a discharge conduit 204. After some or all of the soiled wash fluid is discharged, fresh water and/or wash additives may be added and the wash or rinse cycle may be repeated.

Figure 5:
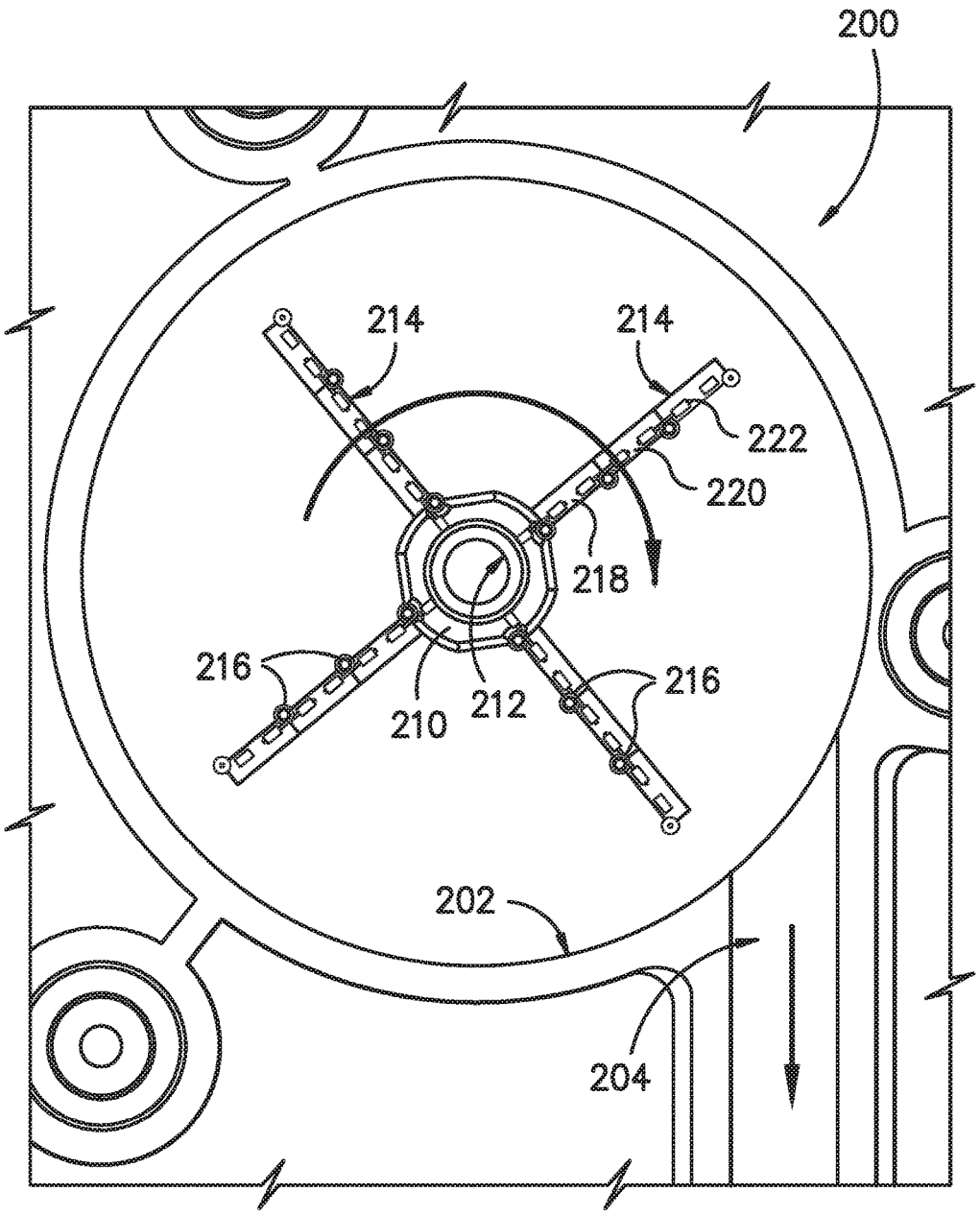
FIG. 5 provides a top, cross sectional view of the exemplary drain pump assembly of FIG. 4 rotating in a wash direction according to an example embodiment of the present subject matter.
Figure 6:
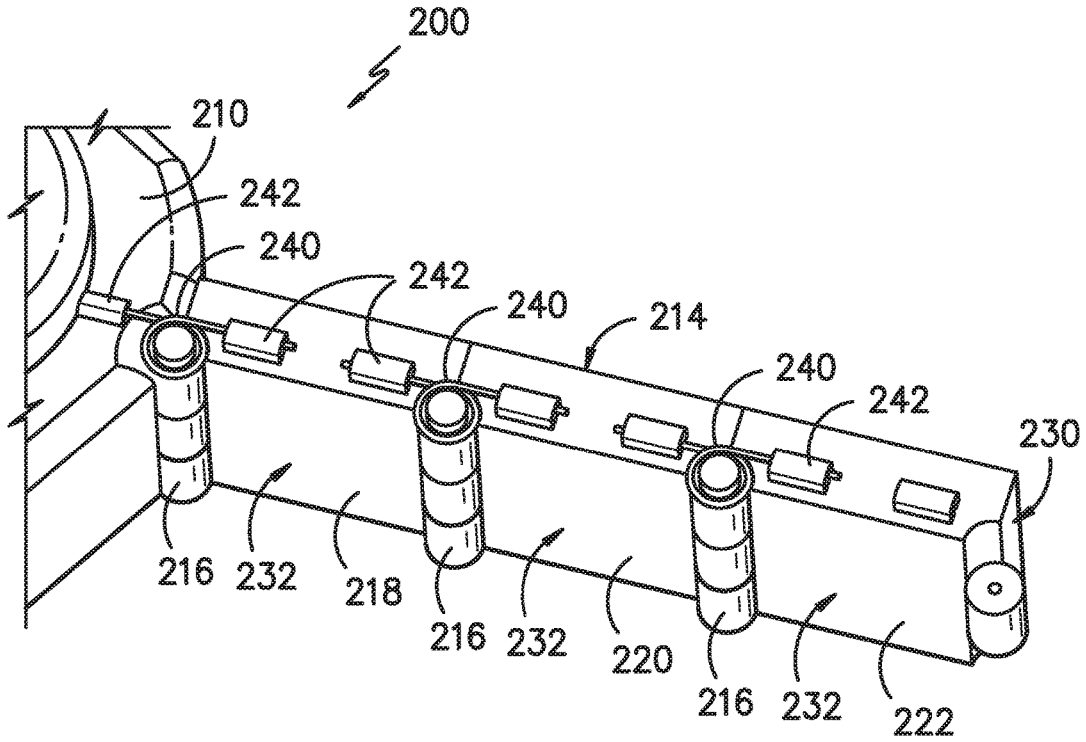
FIG. 6 provides a close-up, perspective view of the exemplary drain pump assembly of FIG. 4 rotating in the wash direction according to an example embodiment of the present subject matter.

As best illustrated in FIGS. 4 through 6, drain pump assembly 200 generally includes a hub 210 that is mounted to drive shaft 176. Hub 210 has a circular bore 212 that is configured for receiving a bottom end of drive shaft 176. In an embodiment, drive shaft 176 and hub 210 may be keyed so as to be in cooperative engagement. In this regard, for example, drive shaft 176 may include one or more features, such as protrusions (not shown), in cooperative engagement with one or more features, such as recesses (not shown), in hub 210, or vice versa. In addition, one or more pins, retaining clips, or other mechanical retention devices may be used to fix hub 210 to drive shaft 176.

According to the illustrated exemplary embodiment, one or more vanes 214 are rotatably coupled to hub 210. More specifically, as illustrated in FIG. 5, drain pump assembly 200 includes four vanes 214, each vane 214 being positioned equidistantly around a circumference of hub 210. In this regard, for example, one vane 214 is positioned in each quadrant of hub 210 when viewed along the axial direction A, such that each vane 214 is separated by ninety degrees.

As best illustrated in FIG. 6, vanes 214 are pivotally mounted to hub 210 using a hinge 216. According to the illustrated embodiment, each hinge 216 includes two or more hinge knuckles that are joined using a hinge pin. However, it should be appreciated that any suitable type of hinge or method of pivotally mounting vane 214 to hub 210 may be used according to alternative embodiments.

Each vane 214 may include one or more vane links. For example, according to the illustrated embodiment, each vane 214 includes three vane links—a first vane link 218 coupled to hub 210, a second vane link 220 coupled to first vane link 218, and a third vane link 222 coupled to second vane link 220. Hinges 216 may be used to join each of the vane links 218-222 of vane 214. According to the illustrated embodiment, each vane link 218-222 is identical in size, shape, and hinge configuration. However, it should be appreciated that vane links 218-222 may have varying sizes or configurations according to alternative embodiments. In addition, more or fewer than three vane links may make up each vane 214 according to alternative embodiments.

Vane links 218-222 are connected to form vane 214 such that vane may be moved between the extended and the retracted position. For example, using first vane link 218 as an example, first vane link 218 defines two blocking faces 230 and a seating face 232. Each hinge 216 is oriented along the vertical direction V where blocking faces 230 meet seating face 232. As described below, such a configuration allows vane 214 to pivot between an extended position when wash fluid needs to be drained from dishwasher and a retracted position when wash pump impeller 182 is circulating wash fluid and it is undesirable to drain wash fluid.

In the extended position, illustrated in FIGS. 4 through 6, blocking face 230 of first vane link 218 engages a complementary surface of hub 210 such that it cannot pivot any further and extends substantially along the radial direction R. Similarly, blocking face 230 of second vane link 220 engages the opposite blocking face 230 of first vane link 218 and blocking face 230 of third vane link 222 engages the opposite blocking face 230 of second vane link 222. In this manner, vane links 218-222 are aligned substantially along the radial direction R but are rigidly engaging each other such that the flow of wash fluid cannot push vane 214 beyond the radial direction R. It should be appreciated, that as used herein, terms of approximation, such as "approximately," "substantially," or "about," refer to being within a ten percent margin of error.

Figure 7:
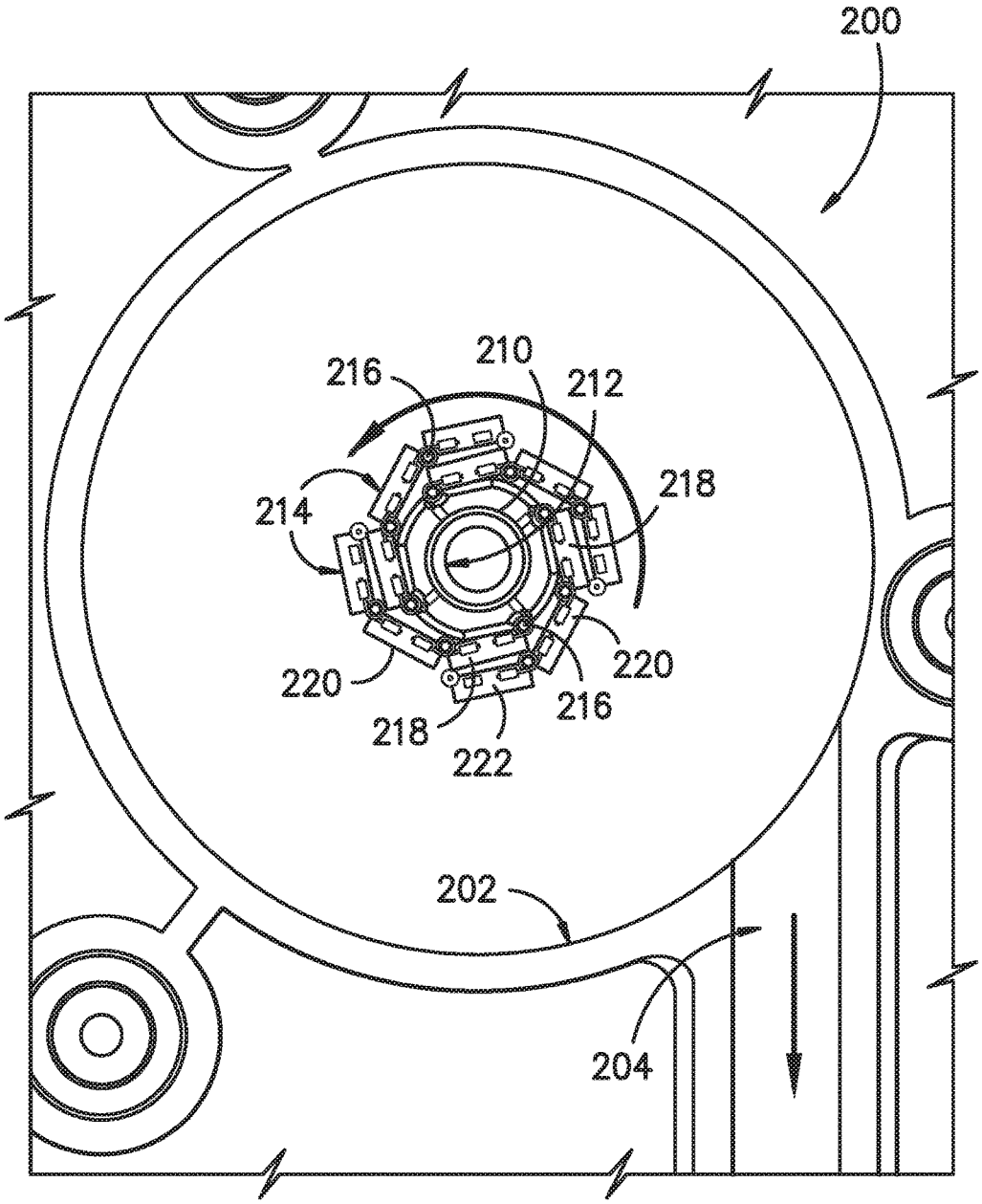
FIG. 7 provides a top, cross sectional view of the exemplary drain pump assembly of FIG. 4 rotating in a wash direction according to an example embodiment of the present subject matter.
Figure 8:
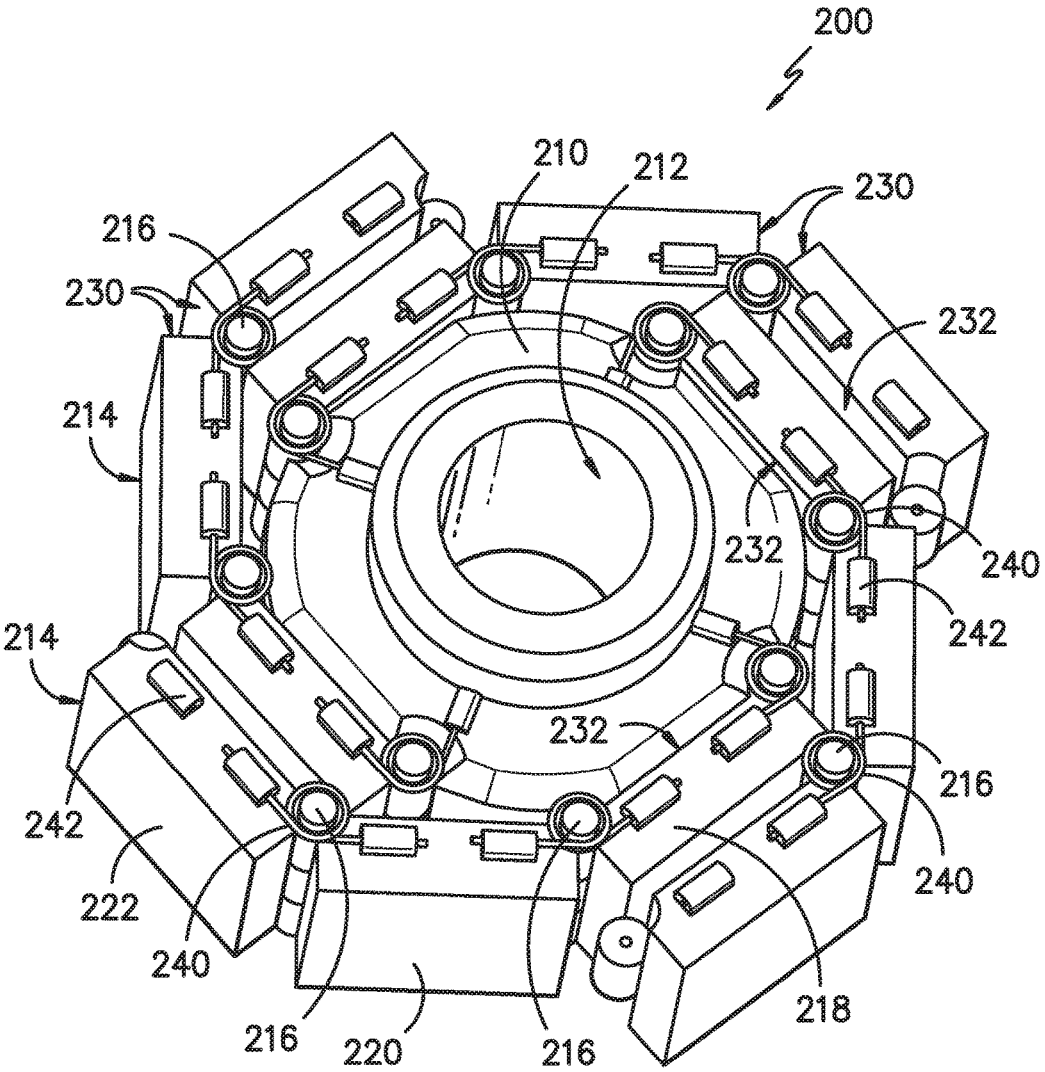
FIG. 8 provides a close-up, perspective view of the exemplary drain pump assembly of FIG. 4 rotating in the wash direction according to an example embodiment of the present subject matter.

By contrast, in the retracted position, illustrated in FIGS. 7 and 8, the seating face 232 of first vane link 218 engages a complementary surface of hub 210. In addition, second vane link 220 and third vane link 222 are circumferentially wrapped around hub 210 such that their seating faces 232 are contacting hub 210 or an adjacent vane 214. In this regard, vane 214 is wrapped around hub 210 and forms a low profile that generates little pressure head while drive shaft 176 is rotating in the wash direction.

As illustrated in FIGS. 5 through 8, a biasing member, e.g., a spring 240, is positioned on each hinge 216 for urging vane 214 to the retracted position. More specifically, a spring 240 may positioned between hub 210 and first vane link 218, between first vane link 218 and second vane link 220, and between second vane link 220 and third vane link 222. Springs 240 are configured to be in tension when vane 214 is in the extended position, such that vane 214 is urged into the retracted configuration. According to the illustrated embodiment, hub 210 and vane links 218-222 each define spring mounts 242 which secure springs 240 and ensure the tension is increased as vane 214 moves toward the extended position. However, it should be appreciated that springs 240 may be mounted in any suitable manner.

Although springs 240 are illustrated as identical mechanical torsion springs, it should be appreciated that any suitable resilient member may be used to urge vane 214 toward the retracted position. Moreover, each spring 240 may have a different stiffness and some hinges 216 may have no springs at all according to some exemplary embodiments. For example, a spring constant or stiffness of springs 240 may be selected to counteract the centrifugal force exerted on each vane 214 due to the rotation of hub 210. The spring constant may also be selected to allow vane 214 to reach the extended position under force of water to allow the fluid pumping action when desired, e.g., during a drain cycle.

Thus, as described above, vanes 214 are generally configured to move between an extended position or orientation and a retracted position or orientation. For example, when drive shaft 176 is rotating in a first direction, e.g., a "drain direction," vanes 214 are in the extended position, as shown in FIGS. 4 through 6. When vanes 214 are extended in this manner, drain pump assembly 200 pumps wash fluid out of discharge conduit 204, thereby emptying the wash fluid and soil from sump portion 144. More specifically, by rotating drive shaft 176 in the drain direction, the force of the water being moved by each vane 214 causes the vane 214 to straighten and extend substantially along the radial direction R. According to the illustrated embodiment, each vane 214 has the same length and extends from hub 210 approximately to the outer circumference of drain pump volute 202.

By contrast, when drive shaft 176 is rotating in a second direction, e.g., a "wash direction," vanes 214 are in the retracted position, as shown in FIGS. 7 and 8. More specifically, by rotating drive shaft 176 and drain pump assembly 200 in the wash direction, the spring force (e.g., from spring 240) and the force of water exerted on each vane 214 causes the vanes 214 to wrap around hub 210. For example, as best illustrated in FIG. 8, the first link 218 of vane 214 lays flush against hub 210, while second link 220 and third link 222 of vane 214 rest on top of the adjacent, downstream vane 214. In this manner each vane 214 has a low profile that generates very little pressure head.

Hub 210 may have a substantially circular cross section when viewed along the axial direction A. Alternatively, hub 210 may define a plurality of flat or otherwise complementary surfaces configured to receive the plurality of vanes 214. In this manner, by having each vane 214 sitting flush with a complementary surface of hub 210, the tendency of wash fluid to flow between the vane and hub 210, thereby urging vane 214 into the extended position, is reduced.

It should be appreciated that drain pump assembly 200 is used only for the purpose of explaining aspects of the present subject matter. Modifications and variations may be made to drain pump assembly 200 while remaining within the scope of the present subject matter. For example, the number, size, spacing, and configuration of vanes 214 may be adjusted while remaining within the scope of the present subject matter. In addition, other embodiments may use more than four vanes having variable lengths, the vanes may have a different number and/or size of links, a different hinge configuration may be used, and biasing members may have a different size or configuration.

Drain pump assembly 200 as described above enables both a wash pump impeller and a drain pump impeller of a dishwasher fluid circulation system to be placed on a single drive shaft. In this manner, a single, reversible drive motor can rotate the drive shaft in a first direction for drain cycles and in the opposite direction for wash/rinse cycles. Furthermore, because the vanes of the exemplary drain pump assembly 200 fold up when the drive shaft is rotating in the wash direction, they do not drain the wash fluid from the sump of the dishwasher during a wash/rinse cycle. Moreover, drain pump assembly 200 eliminates the need for complicated valve systems to prevent undesirable draining of the dishwasher and reduces the amount of shaft power necessary to overcome excess drag due to a conventional drain pump impeller.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fluid circulation assembly defining a vertical direction and comprising:

a drive shaft defining an axial direction, a radial direction, and a circumferential direction;

a motor operable to rotate the drive shaft in a first direction and in a second direction opposite the first direction; and a drain pump assembly comprising:

a hub mounted to the drive shaft, the hub defining a radial outer surface;

a vane coupled to the radial outer surface of the hub and being movable between an extended position when the motor is rotating in the first direction and a retracted position when the motor is rotating in the second direction; and a biasing member urging the vane to the retracted position, wherein the biasing member is a mechanical coil spring.

2. The fluid circulation assembly of claim 1, wherein the vane comprises:

a first link rotatably coupled to the hub by a first hinge;

a first biasing member coupled to an axial face of the hub and the first link for urging the first link toward the retracted position;

a second link rotatably coupled to the first link by a second hinge; and a second biasing member coupled to the first link and the second link for urging the second link toward the retracted position.

3. The fluid circulation assembly of claim 1, wherein the drain pump assembly comprises four vanes, each of the four vanes being rotatably mounted in a different circumferential quadrant of the hub.

4. The fluid circulation assembly of claim 1, wherein the vane defines a blocking face and a seating face, the vane being pivotally connected to the hub at a pivot point defined where the blocking face meets the seating face, such that the seating face sits flush against the hub when the vane is in the retracted position and the blocking face sits flush against the hub when the vane is in the extended position.

5. The fluid circulation assembly of claim 1, wherein the vane is circumferentially wrapped around the hub when the vane is in the retracted position and extends substantially along the radial direction when the vane is in the extended position.

6. The fluid circulation assembly of claim 1, further comprising a wash pump impeller coupled to the drive shaft.

7. The fluid circulation assembly of claim 6, further comprising a filter defining an aperture, the drive shaft extending through the aperture, and the wash pump impeller being coupled to the drive shaft above the filter along the vertical direction and the drain pump assembly being coupled to the drive shaft below the filter along the vertical direction.

8. The fluid circulation assembly of claim 1, wherein the drain pump assembly is positioned at a bottom of a sump area of a dishwasher and is in fluid communication with a discharge conduit for draining wash fluid.

9. The fluid circulation assembly of claim 1, wherein the motor is vertically oriented within a sump area of a dishwasher, such that the drive shaft is vertically oriented relative to the dishwasher.

10. A dishwasher appliance defining a vertical, a lateral, and a transverse direction, the dishwasher appliance comprising:

a wash tub that defines a wash chamber;

a wash rack mounted within the wash chamber, the wash rack being configured for receiving articles for washing; and a fluid circulation assembly for providing a flow of wash fluid for cleaning articles placed within the wash chamber, the fluid circulation assembly comprising:

a drive shaft defining an axial direction, a radial direction, and a circumferential direction;

a motor operable to rotate the drive shaft in a first direction and in a second direction opposite the first direction;

a hub mounted to the drive shaft, the hub defining a radial outer surface;

a vane coupled to the radial outer surface of the hub and being movable between an extended position when the motor is rotating in the first direction and a retracted position when the motor is rotating in the second direction; and a biasing member urging the vane to the retracted position, wherein the biasing member is a mechanical coil spring.

11. The dishwasher appliance of claim 10, wherein the vane comprises:

a first link rotatably coupled to the hub by a first hinge;

a first biasing member coupled to an axial face of the hub and the first link for urging the first link toward the retracted position;

a second link rotatably coupled to the first link by a second hinge; and a second biasing member coupled to the first link and the second link for urging the second link toward the retracted position.

12. The dishwasher appliance of claim 10, wherein the fluid circulation assembly comprises four vanes, each of the four vanes being rotatably mounted in a different circumferential quadrant of the hub.

13. The dishwasher appliance of claim 10, wherein the vane defines a blocking face and a seating face, the vane being pivotally connected to the hub at a pivot point defined where the blocking face meets the seating face, such that the seating face sits flush against the hub when the vane is in the retracted position and the blocking face sits flush against the hub when the vane is in the extended position.

14. The dishwasher appliance of claim 10, wherein the vane is circumferentially wrapped around the hub when the vane is in the retracted position and extends substantially along the radial direction when the vane is in the extended position.

15. The dishwasher appliance of claim 10, further comprising a wash pump impeller and a filter defining an aperture, the wash pump impeller being coupled to the drive shaft above the filter along the vertical direction and the hub being coupled to the drive shaft below the filter along the vertical direction.

16. The dishwasher appliance of claim 10, wherein the hub and the vane are positioned at a bottom of a sump area of the dishwasher appliance.

17. The dishwasher appliance of claim 10, wherein the motor is vertically oriented within a sump area of the dishwasher appliance, such that the drive shaft is vertically oriented relative to the dishwasher appliance.

* * * * *